United States Patent [19]

Ausnit

[11] Patent Number: 4,706,297

[45] Date of Patent: Nov. 10, 1987

[54] FOLDABLE TOP BAG AND METHOD

[75] Inventor: Steven Ausnit, New York, N.Y.

[73] Assignee: Minigrip, Inc., Orangeburg, N.Y.

[21] Appl. No.: 852,641

[22] Filed: Apr. 16, 1986

[51] Int. Cl.[4] ..... B65D 33/16

[52] U.S. Cl. ..... 383/63; 383/89; 383/122

[58] Field of Search ..... 383/63, 65, 68, 84, 383/85, 88, 89, 122

[56] References Cited

U.S. PATENT DOCUMENTS

| | | | |
|---|---|---|---|
| 3,023,679 | 3/1962 | Prazze | 383/122 |
| 3,446,420 | 5/1969 | Rinecker | 383/89 |
| 3,554,436 | 1/1971 | Palmer | 383/89 |
| 3,958,750 | 5/1976 | Prybeck | 383/63 |
| 4,318,506 | 3/1982 | Hirsch | 383/89 |
| 4,561,109 | 12/1985 | Herrington | 383/63 |

*Primary Examiner*—Willis Little

*Attorney, Agent, or Firm*—Hill, Van Santen, Steadman & Simpson

[57] ABSTRACT

A container in the form of a collapsable bag is provided with a pair of opposed expandably connected walls providing a top opening. A foldable top provided by upper end portions of the container walls is adapted to be folded over for closing the top opening. Complementary reclosable fastener structure carried on outer faces of the upper wall portions releasably holds the foldable top in folded condition. The fasteners may be in the form of complementary extruded multi-profile fastener strips. There may be one strip on each of the wall portions for holding the top in double folded condition, or there may be a plurality of complementary fastener strips on the wall portions for selectively holding the bag top in quadruple folded condition.

9 Claims, 6 Drawing Figures

FOLDABLE TOP BAG AND METHOD

BACKGROUND OF THE INVENTION

This invention relates to containers, and more particularly to containers of the bag type having a pair of opposed expandably connected walls providing a top opening, and new and improved reclosable means and method therefor.

Various and sundry reclosable containers of the bag type have been provided heretofor. A popular reclosable fastener device for such bags has comprised complementary resilient extruded plastic fastener strips having separably interlockable profiles which can be pressed together for closing the fastener and pulled apart to open the fastener. These fasteners have commonly been associated with the inside wall areas of opposed expandably connected walls of the bags, and in most instances one or both of the opposite ends of the fastener strips have been connected together such as in the side seam seals of the bags. However, for some purposes the connected ends of the fastener strips undesirably restricts expansion of the top opening of the container. This is particularly true where the container is of the gussetted bag type, although such restriction on bag top opening may also be undesirable for certain purposes on bags of the type where the sides of the bag walls are connected without gussets.

On foldable top containers of the bag type twistable or tieable side extensions have been employed for reclosably closing the foldable bag tops. Such side extensions have heretofor been necessary even where the foldable tops have been equipped with extruded plastic profile fastener means on the inner sides of the bag top walls.

SUMMARY OF THE PRESENT INVENTION

An important object of the present invention is to provide a new and improved foldable top bag and method wherein complementary reclosable fastener means are provided on outer faces of the upper wall portions for releasably holding the foldable top in folded condition.

Another object of the invention is to provide a new and improved foldable top bag and method having a novel arrangement of complementary extruded plastic profile reclosable fastener means.

More particularly, the present invention provides a new and improved reclosable fastener means of the resilient extruded complementary profiled reclosable fastener structure especially arranged for releasably holding foldable tops of containers in folded condition.

Pursuant to the present invention, there is provided in a container having a pair of opposed expandably connected walls providing a top opening, a foldable top provided by upper end portions of the walls and adapted to be folded over for closing the top opening, and complementary reclosable fastener means carried on outer faces of the upper wall portions for releasably holding the foldable top in folded condition.

The present invention also provides a new and improved method for making and reclosably closing a foldable top container.

BRIEF DESCRIPTION OF THE DRAWINGS

Other objects, features and advantages of the present invention will be readily apparent from the following description of representative embodiments thereof, taken in conjunction with the accompanying drawing, although variations and modifications may be effected without departing from the spirit and scope of the novel concepts embodied in the disclosure, and in which.

DETAILED DESCRIPTION

Figure 1:
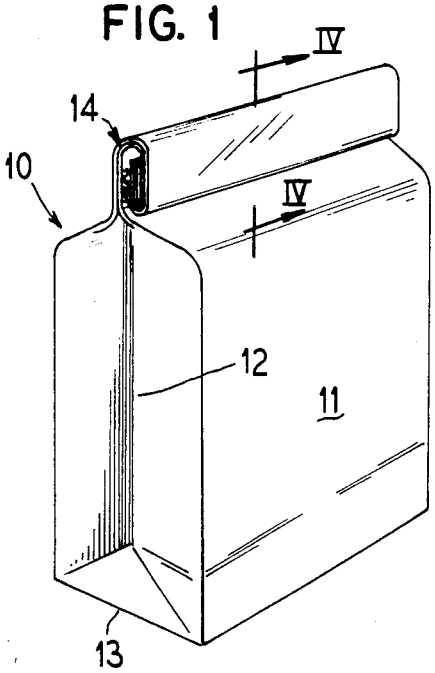
FIG. 1. is a perspective view of a foldable top container of the gussetted bag type embodying the present invention.

On reference to FIGS. 1–4, a container 10 of the conventional gussetted bag type is depicted and which has a pair of opposed walls 11 expandably connected as by means of side gussets 12 and an expandable square bottom 13. If preferred, of course, the sides and bottom of the bag 10 may be of the conventional type wherein the sides and bottom do not have the gusset and foldable characteristics, although the sides and bottom may balloon to at least some extent under expansion of the inner space of the container.

Figure 4:
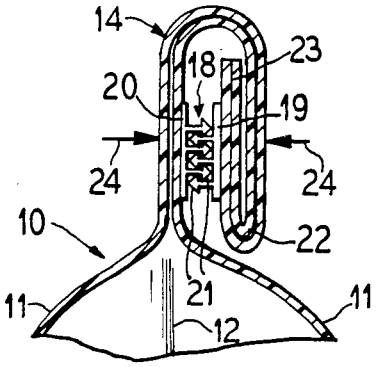
FIG. 4 is a fragmentary, enlarged sectional detail view taken substantially along the line IV—IV in FIG. 1.

A foldable top 14 is provided by upper end portions 15 of the walls 11. As shown in FIGS. 1 and 4, the foldable top 14 is adapted to be folded over for closing a top opening 17 for the bag 10. Desirably, the top opening 17 may be expanded without interference to the full expansion of the bag walls 11.

In order to permit full expansion of the bag top 14, but nevertheless allow thorough closure of the top opening 17 by folding the foldable top 14 and holding the foldable top in folded condition as demonstrated in FIGS. 1 and 4, complementary reclosable fastener means 18 are carried on outer faces of the upper wall portions 15. In a preferred form, the reclosable fastener means 18 comprises an extruded plastic fastener strip 19 on the outer face of one wall portion 15 and a complementary extruded plastic fastener strip 20 on the outer face of the other wall portion 15. In this instance, the fastener strip 19 is located parallel and close to the upper edge of the wall portion 15 to which attached. The fastener strip 20 is attached close to the lower end of the wall portion 15 to which this strip is attached. Any desired manner of attachment of the strips 19 and 20 to the bag may be employed suitable for the particular circumstances, such as by adhesive means, or by fusion welding where possible. Both of the strips 19 and 20 have their ends adjacent to the side edges of the respective wall portions 15.

For facilitating and enhancing interengagement of the complementary fastener strip 19 and 20, each of them is provided with a plurality of resiliently flexible, spaced, parallel, fastener profiles 21 which in a desirable form may be of generally arrow-shaped cross section. By the differential location of the fastener strips 19 and 20 relative to the length, that is, the height, of the bag 10, the fastener strip 19 is adapted to be releasably interlocked with the fastener strip 20 by folding the bag top 14 upon itself with a double fold 22 as shown in FIGS. 1 and 4 comprising a return bent terminal flange 23. This orients the fastener strip 19 opposite the fastener strip 20 in such manner that by applying opposite pressure as indicated by the directional arrows 24, the profiles 21 of the fastener strips will be pressed into interlocking relation, thereby releasably holding the foldable top 14 in the folded condition. This maintains the bag opening 17 thoroughly closed.

Figure 2:
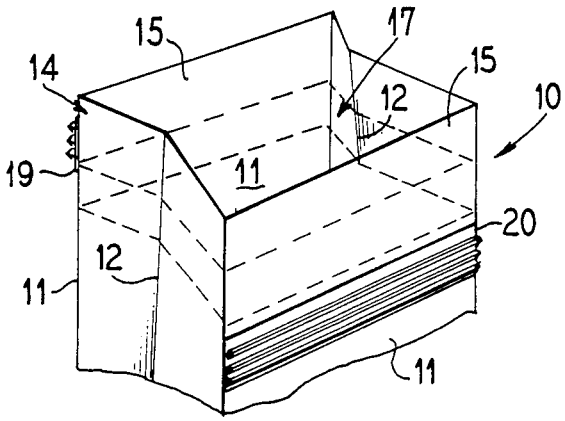
FIG. 2 is a fragmentary perspective view showing the foldable top of the bag in expanded open condition.
Figure 3:
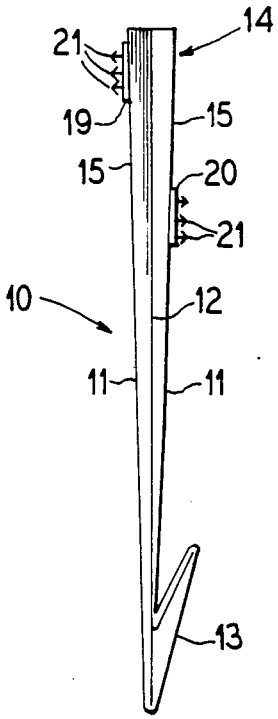
FIG. 3 is a side elevational view of the container of FIG. 1 showing the same in collapsed condition.

When it is desired to open the bag 10, the fold 22 can be grasped and while the bag is firmly held, a pull on the fold 22 will release the profiles of the strip 19 from the profiles of the strip 20. The unfolded bag top 14 can then be spread, i.e., expanded, wide open as depicted in FIG. 2. On the other hand, the bag 10 is adapted to be collapsed into flat condition as shown in FIG. 3 before filling, or after the bag has been emptied. This not only makes it convenient to pack the bags in collapsed condition for storage and handling before filling, but also permits a bag that has been emptied of contents to be collapsed for future use.

Figure 5:
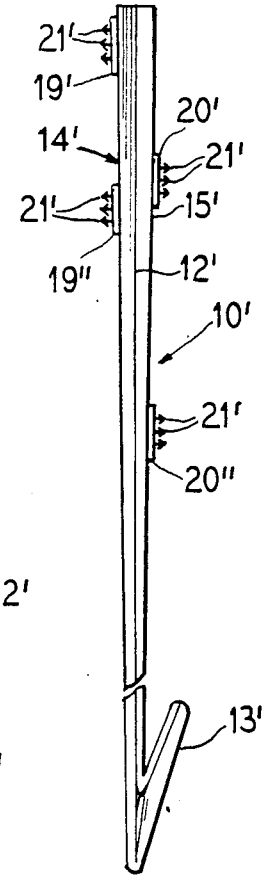
FIG. 5 is a fragmentary side elevational view of a foldable top bag showing a modification embodying a plurality of interlockable fasteners for enabling quadruple folding of the foldable top.
Figure 6:
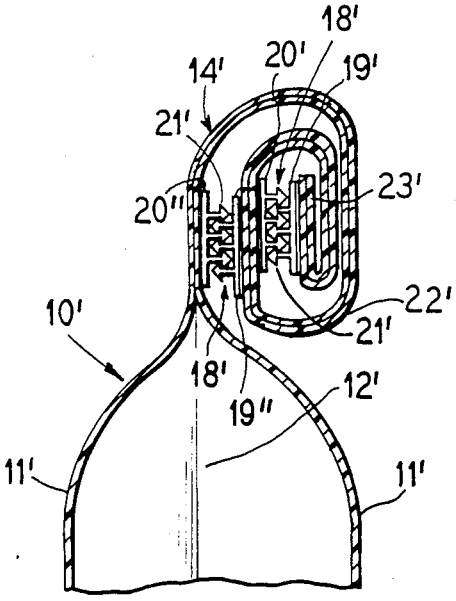
FIG. 6 is a vertical sectional view similar to FIG. 4, but showing the multiple reclosable fastener arrangment of FIG. 5 in the double folded condition of the bag top.

Since it may be desired to reduce empty space within the bag as contents are used up, additional fastener means are provided in FIGS. 5 and 6 so that the bag top may be selectively double folded or quadruple folded. For this purpose, the bag 10′ may, similarly as the bag 10, have side walls 11′ connected by side gussets 12′, a square bottom 13′ and a foldable top 14′. One of the upper wall portions 15′ carries a fastener strip 19′ of similar structure as the strip 19 in FIGS. 1–4, in adjacent space parallel relation on the uppermost area of the wall portion 15′ on which carried. On the outer face of the other upper wall portion 15′, a complementary reclosable fastener strip 20′ of similar structure as the strip 20 in FIGS. 1–4, is arranged to interengagably receive the fastener 19′ when the bag top is double folded. This folded condition will be the same as the folded bag top shown in FIG. 4.

When contents within the bag chamber 12′ is used up so that there is empty space which may be taken up by further folding the bag top may be selectively held in quadruple folded condition by interengagement of a second fastener strip 19″ carried in spaced parallel relation at a proper position below the fastener strip 19′ and interengagable with a complementary fastener strip 20″ in spaced parallel relation below the fastener strip 20′. This results in the quadruple folded condition depicted in FIG. 6. Opening of the bag top from either the double folded or quadruple folded condition can be effected by pulling the folded bag top open and releasing the fasteners which have held the bag top in the double folded and/or quadruple folded condition.

In either form of the invention, by virtue of the reclosable fasteners being on the outside surfaces of the bag top, and the ends of the fastener strip section or sections on one side of the bag free from the ends of the fastener strip section or sections on the other side of the bag, the bag top can be spread fully open when desired. On the other hand, when the bag top has been folded over and the reclosable fasteners interlocked, a thorough closure is provided for the bag.

It will be understood that variations and modifications may be effected without departing from the spirit and scope of the novel concepts of the present invention.

I claim as my invention:

1. In a container having a pair of opposed expandably connected walls providing a top opening:

a foldable top provided by upper end portions of said walls and adapted to be folded for closing said top opening;

complementary reclosable extruded plastic fastener strips carried on and extending across the outer faces of said upper wall portions for releasably holding said foldable top in folded condition; and each of said strips having a plurality of resiliently flexible arrow-shaped profiles, all of which on both strips are essentially identical and project away from the wall portion on which the respective strip is carried so that when said top is folded to orient the fastener strips into opposed relation the profiles of the strips can be interlocked by pressing the folded upper end portions of the bag walls toward one another by pressure directed simultaneously from opposite directions towards said fastener strips.

2. A container according to claim 1, wherein said walls are connected by gussets.

3. A container according to claim 1, wherein sasid fastener means comprise a plurality of parallel extruded plastic multi-profile fastener strips carried on the outer face of one of said upper end wall portions, and a corresponding plurality of complementary extruded plastic fastener strips located on the other of said upper wall portions, so that the fastener strips on said wall portions are interengagable for holding said foldable top selectively in double folded and quadruple folded condition.

4. In a container having a pair of opposed expandably connected walls providing a top opening:

a foldable top provided by upper end portions of said walls and adapted to be folded or closing said top opening;

complementary reclosable fastener means carried on outer faces of said upper end wall portions for releasably holding said foldable top in folded condition;

said fastener means comprising a plurality of spaced parallel extruded plastic multi-profile fastener strips carried on the outer face of one of said upper end wall portions, and a corresponding plurality of spaced parallel complementary extruded plastic fastener strips located on the other of said upper end wall portions, so that the complementary fastener strips on said upper end wall portions are interengagable for holding said foldable top selectively in double folded and quadruple folded condition, and in said quadruple folded condition certain of said strips are interengaged and enwrapped in said quadruple folded condition of said top.

5. A method of making a foldable top container, comprising:

providing the container with a pair of opposed walls;

expandably connecting said walls and providing a top opening between upper end portions of said walls;

providing complementary reclosable extruded plastic strips on and extending across the outer faces of said upper wall portions;

providing each of said strips with a plurality of resiliently flexible arrow-shaped profiles, all of which on both of said strips being essentially identical and projecting away from the wall portion on which the respective strip is carried;

folding said container top upon itself and orienting the fastener strips into opposed relation; and pressing the bag top by pressure directed simultaneously in opposite directions toward said fastener strips and thereby releasably interengaging and interlocking said fastener strip profiles for holding said top in folded condition.

6. A method according to claim 5, comprising connecting walls by gussets.

7. A method according to claim 5, comprising providing said fastener means in the form of a plurality of parallel extruded plastic multi-profile fastener strips on the outer face of one of said upper end wall portions, and providing a corresponding plurality of complementary extruded plastic fastener strips on the other of said upper wall portions, and interengaging the fastener strips on said wall portions selectively for holding said foldable top in double folded or quadruple folded condition.

8. A method according to claim 5, comprising double folding said top with the fastener means on one of said faces on a return folded terminal flange in opposition to the complementary fastener means on the other face.

9. A method of making a foldable top container, comprising:

providing the container with a pair of opposed walls;

expandably connecting said walls and providing a top opening between upper end portions of said walls;

providing a plurality of spaced parallel extruded plastic multi-profile fastener strips on the outer face of one of said upper end wall portions;

providing a corresponding plurality of complementary spaced parallel extruded plastic fastener strips on the other of said upper wall portions;

interengaging the complementary fastener strips on said wall portions selectively for holding said folded top in double folded or quadruple folded condition; and in said quadruple folded condition enwrapping certain of said interengaged strips in the quadruple folded top.

* * * * *